US010502053B2

(12) United States Patent
Anderson et al.

(10) Patent No.: US 10,502,053 B2
(45) Date of Patent: Dec. 10, 2019

(54) SYSTEM, METHOD AND APPARATUS FOR DOWLINKABLE, HIGH SPEED TELEMETRY FOR MEASUREMENT WHILE DRILLING OR LOGGING WHILE DRILLING

(71) Applicant: Standard Directional Services Ltd., Calgary (CA)

(72) Inventors: Desmond Anderson, Calgary (CA); Salvador Berberov, Calgary (CA)

(73) Assignee: Standard Directional Services Ltd., Calgary, Alberta (CA)

( * ) Notice: Subject to any disclaimer, the term of this patent is extended or adjusted under 35 U.S.C. 154(b) by 0 days.

(21) Appl. No.: 16/211,312

(22) Filed: Dec. 6, 2018

(65) Prior Publication Data

US 2019/0106985 A1 Apr. 11, 2019

Related U.S. Application Data

(63) Continuation of application No. 16/031,391, filed on Jul. 10, 2018, now Pat. No. 10,180,060.

(60) Provisional application No. 62/531,008, filed on Jul. 11, 2017.

(51) Int. Cl.
*E21B 47/18* (2012.01)
*E21B 47/09* (2012.01)

(52) U.S. Cl.
CPC ..... *E21B 47/187* (2013.01); *E21B 47/091* (2013.01)

(58) Field of Classification Search
None
See application file for complete search history.

(56) References Cited

U.S. PATENT DOCUMENTS

2005/0231383 A1* 10/2005 Pratt ..... E21B 47/187 340/855.4
2005/0260089 A1* 11/2005 Hahn ..... E21B 47/182 417/505
2010/0025111 A1 2/2010 Gearhart et al.
2013/0292110 A1* 11/2013 Fraser ..... E21B 47/18 166/250.01
2017/0350202 A1* 12/2017 Menconi ..... E21B 47/185

* cited by examiner

*Primary Examiner* — Thomas S McCormack
(74) *Attorney, Agent, or Firm* — Dickinson Wright PLLC; Michael E. Noe

(57) ABSTRACT

A pulser for generating positive pressure mud pulses includes a signal shaft disposed to move between an up position and a down position within a ceramic shaft seal, the signal shaft connected at a top end to a drive shaft, the signal shaft sealing a poppet orifice when in the down position, wherein the drive shaft is connected to an actuator, the actuator connected to a hybrid bearing and a pulser coupling. The pulser is contained in a drill collar and configured to connect to a bottom end assembly. The pulser includes a pressure compensation membrane.

19 Claims, 10 Drawing Sheets

SYSTEM, METHOD AND APPARATUS FOR DOWLINKABLE, HIGH SPEED TELEMETRY FOR MEASUREMENT WHILE DRILLING OR LOGGING WHILE DRILLING

CROSS-REFERENCE TO RELATED APPLICATION AND CLAIM OF PRIORITY

This application is a continuation application of and claims priority to and the benefit of U.S. patent application Ser. No. 16/031,391 filed on Jul. 10, 2018, which claims priority under 35 U.S.C. § 119(e) to U.S. Provisional Patent Application No. 62/531,008 filed on Jul. 11, 2017, each of which is hereby incorporated by reference in its entirety.

TECHNICAL FIELD

This disclosure relates generally to tools for hydroacoustic telemetry and data linking, in particular, hydroacoustic telemetry and data linking using positive pressure mud pulses, with applications including, but not limited to, providing uplink and downlink communications between down hole tool (such as a directional drilling apparatus for generating a hydrocarbon well) and an up hole control terminal. More specifically, this disclosure relates to a system, method and apparatus for downlinkable, high speed telemetry for drilling or logging while drilling.

BACKGROUND

To achieve improved uplink data rates, telemetry systems for coupling downhole tools and sensors (for example, drills used for drilling hydrocarbon wells, and sensors attached to same) have moved away from positive pressure pulse-based mud telemetry, in favor of other technologies, such as electromagnetic telemetry, negative pressure mud pulse telemetry, continuous wave mud pulse telemetry. Similarly, to incorporate effective downlink capability for measurement while drilling ("MWD") and logging while drilling ("LWD"), manufacturers of telemetry systems have moved away from positive pressure pulse-based mud telemetry systems. Overall, the general trend in the art has been away from positive pressure pulse based telemetry systems in the belief that, while inexpensive, such systems could not support the increased uplink data rates and downlink capabilities demanded by users.

SUMMARY

This disclosure provides systems, methods, and apparatus for downlinkable, high speed telemetry for measurement while drilling ("MWD") or logging while drilling ("LWD").

In a first embodiment, a downhole apparatus for generating positive pressure mud pulses including a bottom end assembly contained in a drill collar. The bottom end assembly includes a muleshoe sleeve, a main shaft; a piston cap and a plenum. The plenum includes a wear sleeve, a spring configured to exert a downward force on the piston cap, and a poppet orifice at a top end of the plenum. The apparatus further includes a pulser contained in the drill collar, the pulser connected to the bottom end assembly at the top end of the plenum. The pulser includes a signal shaft disposed to move between an up position and a down position within a ceramic shaft seal, the signal shaft connected at a top end to a drive shaft, the signal shaft sealing the poppet orifice when in the down position, wherein the drive shaft is connected to an actuator, the actuator connected to a hybrid bearing and a pulser coupling. The downhole apparatus also includes a pressure compensation membrane.

In a second embodiment, a pulser for generating positive pressure mud pulses includes a signal shaft disposed to move between an up position and a down position within a ceramic shaft seal, the signal shaft connected at a top end to a drive shaft, the signal shaft sealing a poppet orifice when in the down position, wherein the drive shaft is connected to an actuator, the actuator connected to a hybrid bearing and a pulser coupling. The pulser is contained in a drill collar and configured to connect to a bottom end assembly. The pulser includes a pressure compensation membrane.

In a third embodiment, an external apparatus for establishing a downlink with a downhole apparatus includes a network interface, a controller comprising a processor, and a memory containing computer-executable program code, which when executed by the processor, causes the apparatus to install, via the network interface, to at least one of a directional unit, a transducer, rig instrumentation, or a pulser actuator, program means for establishing a communications using positive pressure pulse downlink between the external apparatus and a downhole tool, and establish, via the installed program means, the positive pressure pulse downlink between the external apparatus and the downhole tool.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

FIGS. 1 through 12, discussed below, and the various embodiments used to describe the principles of this disclosure in this patent document are by way of illustration only and should not be construed in any way to limit the scope of the disclosure. Those skilled in the art will understand that the principles of this disclosure may be implemented in any suitably arranged wireless communication system.

Figure 1:
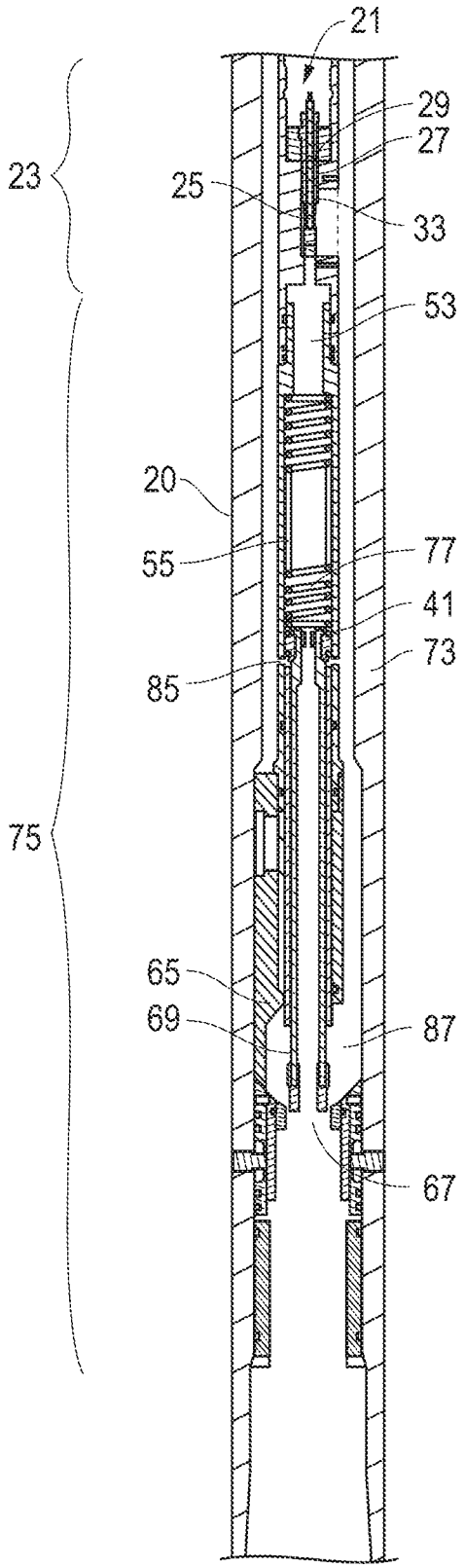
FIG. 1 illustrates a side view of a downhole apparatus for generating positive pressure mud pulses according to various embodiments of this disclosure.
Figure 2:
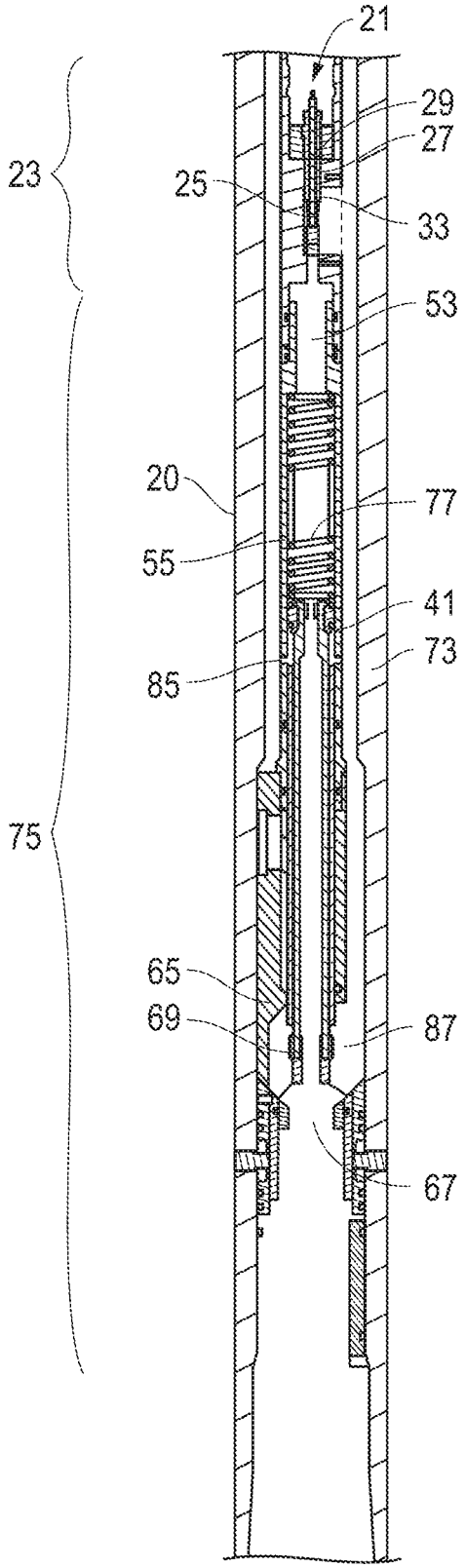
FIG. 2 illustrates a second side view of a downhole apparatus for generating positive pressure mud pulses according to certain embodiments of this disclosure.
Figure 3:
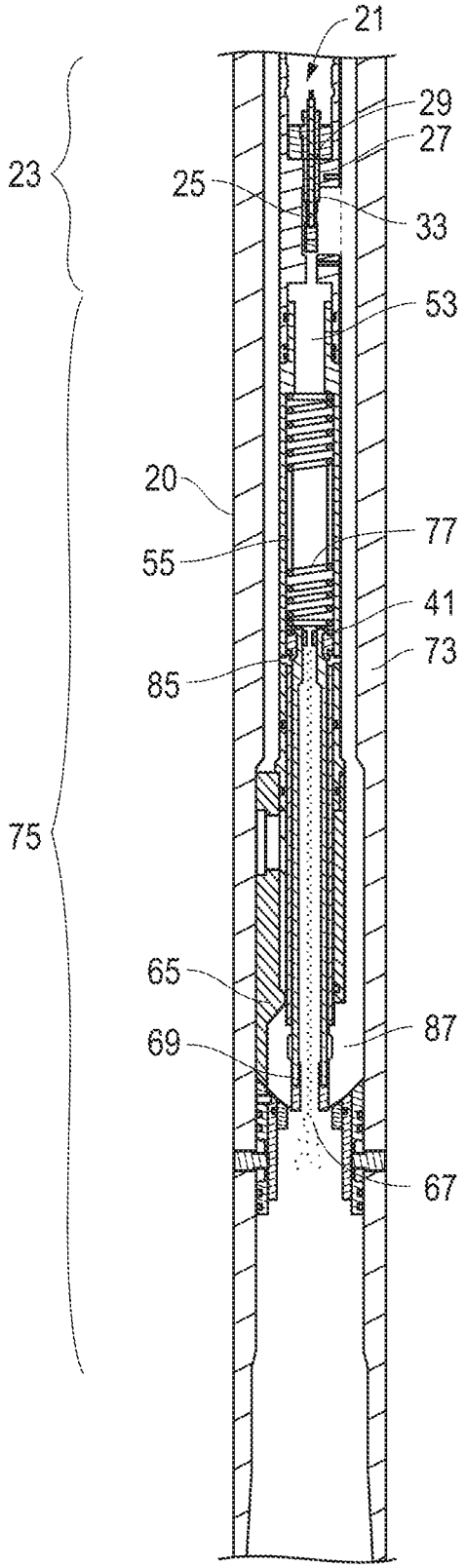
FIG. 3 illustrates a third side view of a downhole apparatus for generating positive pressure mud pulses according to some embodiments of this disclosure.

FIGS. 1, 2 and 3 illustrate side views of a downhole apparatus for generating positive pressure mud pulses according to various embodiments of this disclosure.

The technical challenges associated with achieving, with positive pressure mud pulse telemetry, uplink data rates comparable to other technologies (for example, electromagnetic ("EM") telemetry) include, without limitation, pulse quality and quantity. Achieving higher data rates can require sending more pulses from a downhole apparatus to an external device at the surface. Further, to optimize the data rate, each pulse should have a greater amplitude than background hydraulic noise and interferents detected by a surface transducer.

Referring to the non-limiting example of FIGS. 1-3, a downhole apparatus capable of producing high amplitude positive pressure pulses at a high transmission rate. For the purposes of this disclosure, the term high amplitude positive pressure pulses encompasses pressure pulses having a magnitude significantly greater than the 60-80 psi pressures which can be generated by hydraulic noise in a hydrocarbon well, including, without limitation, pressure pulses on the order of 150 psi. Similarly, for the purposes of this disclosure, the term high transmission rate encompasses pulse frequencies of four or more times those possible with existing positive pressure mud pulse telemetry systems and on the order of the data rates achieved with electromagnetic systems, including pulse frequencies of 8 pulses per second or more.

To generate high amplitude positive mud pressure pulses, certain embodiments according to this disclosure operate by causing a main poppet valve to rapidly switch the flow of a fluid medium (for example, drilling mud) on and off in response to changes in upward pressure on the main shaft. According to certain embodiments, the pressure on the main shaft is regulated by a pulser which includes a signal shaft that opens and closes a second poppet orifice located above the main poppet valve. The action of lifting the second poppet orifice relieves the upward pressure on the main shaft, causing it to thrust downward in response to pressure from a spring in a plenum of a bottom end assembly. This downward motion of the main shaft closes the main poppet, generating a positive pressure pulse which can be detected by a transducer at an external apparatus. By generating detectable positive pressure pulses in predefined sequences, embodiments according to this disclosure can provide an uplink for downhole data. Further, embodiments according to this disclosure can generate high amplitude positive pressure pulses at high transmission rates.

Referring to the non-limiting example of FIGS. 1 through 3, a downhole apparatus 21 in three stages of operation is shown. According to certain embodiments, apparatus 21 comprises part of a tool string used for directional drilling of holes (such as hydrocarbon well 20 shown in FIGS. 1-3). While not shown in FIGS. 1 through 3, the tool string may further comprise a drill bit for removing rock and other material, sensors (for example, temperature or magnetic sensors) for detecting conditions in the hole, and an uplink module for encoding the sensor data as a series of pulses, and for controlling a pulser to transmit the encoded pulses as a predetermined series of positive pressure pulses.

According to certain embodiments, downhole apparatus 21 is deployed within a drill collar 73, for example, a drill collar made of a non-magnetic, high strength material with good galling resistance, such as P530 stainless steel. As shown in FIGS. 1-3 downhole apparatus 21 comprises a bottom end assembly 75 and a pulser 23.

In some embodiments, bottom end assembly 75 comprises muleshoe sleeve 65, main shaft 69, piston cap 41 and plenum 53.

In the non-limiting example of FIGS. 1-3, muleshoe sleeve 65 comprises the lower portion of the tool string shown in FIGS. 1-3, and comprises a substantially cylindrical portion contacting drill collar 73 and supporting main shaft 69. According to certain embodiments, bottom end assembly 75 may further comprise a helix 83 disposed between main shaft 69 and muleshoe sleeve 65. Muleshoe sleeve 65 includes a hollow interior portion which forms main orifice 67. Further, muleshoe sleeve 65 includes, or connects to a passage 87 through which fluid can pass upwards through downhole apparatus 21. As shown in the non-limiting example of FIG. 1, passage 87 is radially disposed between main shaft 69 and drill collar 73.

In certain embodiments according to this disclosure, the lower end of main shaft 69 engages with the main orifice 67 provided by muleshoe sleeve 65 to provide a main poppet for the passage of the fluid medium upward through downhole apparatus 21. Additionally, main shaft 69 is situated such that, when signal shaft 25 is in a "down" position, hydraulic pressure from fluid in the area of plenum port 85 exerts an upward force on main shaft 69.

In the non-limiting example of FIGS. 1-3, piston cap 41 is disposed at an upper end of main shaft 69, and includes a bore through which fluid can pass from the plenum into the hollow portion of the main shaft. Further, according to certain embodiments, piston cap 41 includes a flange or other flat region on an upper surface which can engage with, and push against spring 77.

According to some embodiments, plenum 53 comprises a hollow portion situated above main shaft 69 in the tool string. In the non-limiting example of FIGS. 1-3, plenum 53 further comprises wear sleeve 55, spring 77, and part or all of poppet orifice 71. Plenum 53 provides a region which, depending on the position of signal shaft 25 may exhibit a hydraulic pressure differential relative to passage 87. Further, plenum 53 also comprises a region in which main shaft 69 travels up and down in response to hydraulic pressure differentials created and released by opening and closing of poppet orifice in response to the motion of signal shaft 25.

In some embodiments according to this disclosure, wear sleeve 55 provides a smooth counterface and seal within plenum 53 along which main shaft 69 can readily move up and down without fluid leaking out of the plenum and around the exterior of main shaft 69. According to certain embodiments, wear sleeve 55 may be constructed of a ceramic material, such as silicon nitride ($SiN_4$). According to other embodiments, to handle the heightened material stresses associated with generating high amplitude positive pressure pulses and achieving high data rates, wear sleeve 55 is constructed from a nitrogen-strengthened stainless steel alloy, such as a steel in the NITRONIC™ family of steels.

According to various embodiments, spring 77 is a pulser main spring, having a spring coefficient of approximately 5 to 15 lbs/in, such as about 10 lbs/in.

In certain embodiments, poppet orifice 71 comprises a hole formed in the upper part of plenum 53 and proportioned to fit the end of signal shaft 25 such that when signal shaft 25 is in a down position, the flow of fluid (for example, drilling fluid) through poppet orifice 71 is completely or substantially blocked. As shown in the non-limiting example of FIG. 1, poppet orifice 71 is situated below primary seal 29. According to some embodiments, poppet orifice 71 is also situated below secondary seal 33 in the tool string. Further, as shown in FIG. 1, poppet orifice 71 sits at the interface between passage 87 and plenum 53.

Figure 10:
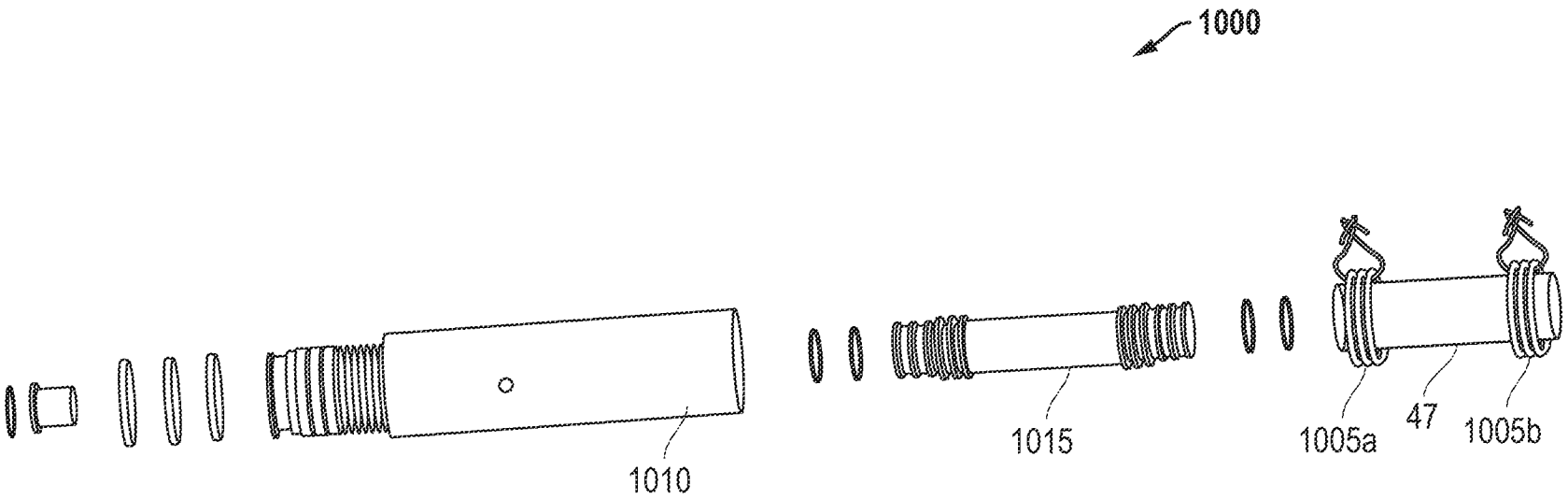
FIG. 10 illustrates an example of a pressure compensator according to certain embodiments of this disclosure.

Moving upwards in the tool string, in the non-limiting example of FIGS. 1-3 pulser 23 connects to the top end of bottom end assembly 75, and comprises a signal shaft 25 and a pressure compensation membrane 47 (shown in FIG. 10). In some embodiments, pulser 23 also comprises some or all of poppet orifice 71. That is, depending on how pulser 23 connects to bottom end assembly 75, poppet orifice 71 may be part of pulser 23, bottom end assembly 75 or both.

According to various embodiments, signal shaft 25 is disposed to move between an up position and a down position within a ceramic shaft seal 27. In some embodiments, signal shaft 25 is constructed of stainless steel and includes one or more lands for holding a t-seal or piston ring to form a seal while signal shaft 25 moves up and down within ceramic shaft seal 27. In some embodiments, signal shaft 25 may further include one or more lands for retaining an end of a secondary seal. Additionally, signal shaft 27 can include a primary seal 29 and a secondary seal 33.

In some embodiments, primary seal 29 comprises a t-seal or ring situated in a land on a region of signal shaft 25. Primary seal 29 operates to provide a slidable seal between signal shaft 25 and ceramic shaft seal 27. As shown in the non-limiting examples of FIGS. 1-3, ceramic shaft seal 27 is situated in a mounting hole in pulser 23 located above poppet orifice 71. According to certain embodiments, ceramic shaft seal 27 comprises a cylindrical section of a ceramic material, such as silicon nitride ($SiN_4$), alumina oxide ($Al_2O_3$), zirconia oxide ($ZrO_2$) or silicon carbide (SiC). Ceramic shaft seal 27 may include at one end, a flange for retaining ceramic shaft seal in the mounting hole, and at another end, one or more lands for retaining an end of a secondary seal.

According to various embodiments, secondary seal 33 comprises a bellows seal which addresses the leakage and wear problems at the primary seal associated with attempting to operate a pulser at high pulse amplitudes and high data transmission rates. In the non-limiting examples shown in FIGS. 1 and 6, secondary seal 33 attaches at one end to a land in ceramic shaft seal 27 and at another end to a land in signal shaft 25.

Figure 11:
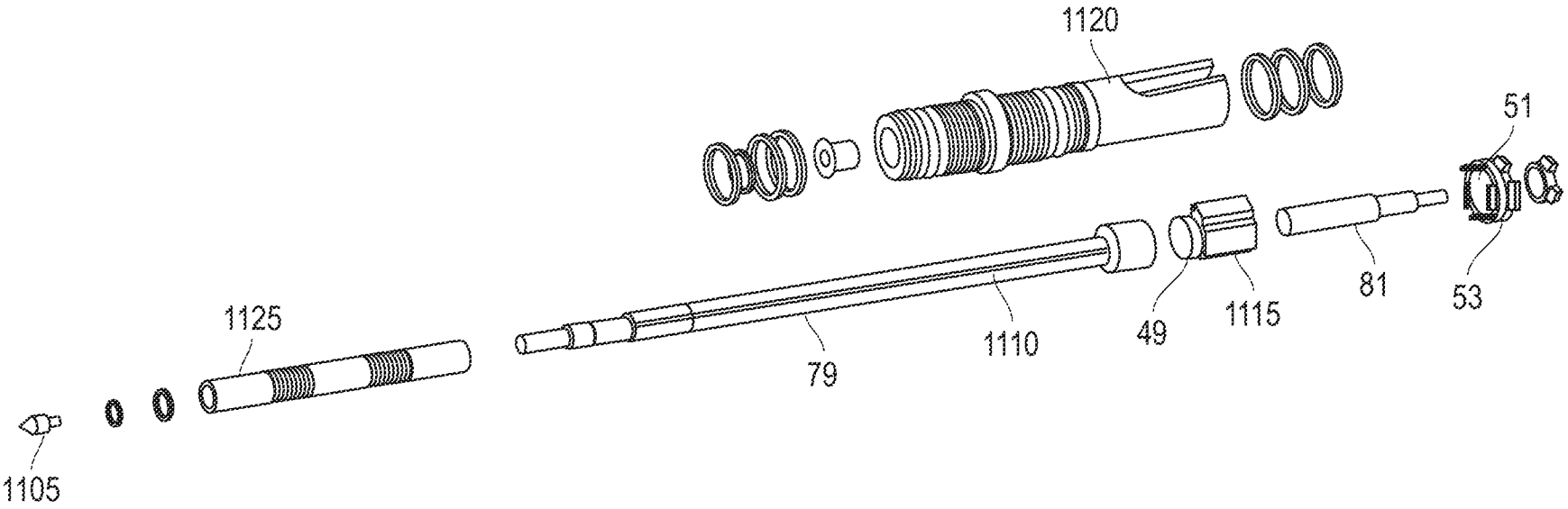
FIG. 11 illustrates an example of a drive shaft assembly according to some embodiments of this disclosure.

In the non-limiting example of FIGS. 1-3, signal shaft 25 is connected at a top end to a drive shaft 79 (shown in FIG. 11), which is in turn connected to an actuator 81 (also shown in FIG. 11).

FIGS. 1 through 3 illustrate three stages of generating a positive pressure mud pulse according to certain embodiments of this disclosure.

FIG. 1 illustrates an operating condition in which no fluid is passing through downhole apparatus 21. As shown in FIG. 1, main shaft 69 is in a down position, and in close proximity to main orifice 67, thereby closing the main poppet valve defined by main shaft 69 and muleshoe sleeve 65. With the main poppet valve closed, no fluid medium can pass through downhole apparatus 21. In FIG. 1, signal shaft 25 is in a down position.

FIG. 2 illustrates an operating condition in which fluid is entering downhole apparatus 21 and moving upwards under hydraulic pressure through passage 87. The pressure of the fluid in passage 87 maintains an upward hydraulic pressure on main shaft 69, causing spring 77 to compress and resist the upward hydraulic pressure from the fluid until an equilibrium between the upward hydraulic pressure from the fluid in passage 87 and the resistive force of compressed spring 77 is achieved.

In FIG. 2, signal shaft 25 is in the down position, blocking the passage of fluid through poppet orifice 71. By blocking the passage of fluid through poppet orifice 71 when in the down position, signal shaft 25 creates a hydraulic pressure differential between passage 87 and plenum 53 and the interior of main shaft 69. In the condition illustrated in FIG. 2, passage 87 is a region of high hydraulic pressure, while plenum 53 and the interior of main shaft 69 comprise regions of low hydraulic pressure.

FIG. 3 illustrates a condition in which signal shaft 25 is moved (for example by the operation of an actuator on a drive shaft connected to the signal shaft) from the down position to an up position, allowing fluid to pass through poppet orifice 71 into plenum 53 and the interior of main shaft 69, thereby removing the hydraulic pressure differential causing main shaft to compress spring 77. In the absence of the upward force caused by the hydraulic pressure differential between the plenum 53 and passage 87, spring 77 pushes main shaft 69 downwards, closing the poppet formed by main orifice 67 and main shaft 69. This closing action generates a positive pressure mud pulse which is transmitted through the fluid medium in the well to external apparatus at the surface.

According to certain embodiments, the positive pressure mud pulse generated by may have a duration of approximately 0.1 seconds to 0.3 seconds, which allows actionable downhole data to be transmitted at a resolution of 4 to 12 bits. As used herein the term actionable downhole data refers to data which, when fully received at an external apparatus at the top of the hole, is sufficiently current to be of use to an operator. As an illustrative example, while it may be possible, for example, to transmit measurement data of the condition of a battery of a downhole tool at a resolution of 256 bits, the time required to generate and transmit the data would be such that, when all of the data was received at the external device, the data no longer accurately reflected the current condition of the battery.

Although FIGS. 1 through 3 illustrate one example of a downhole apparatus, various changes may be made to FIG. 1. For example, bottom end assembly 75 may further comprise a pulser helix 83.

Figure 4:
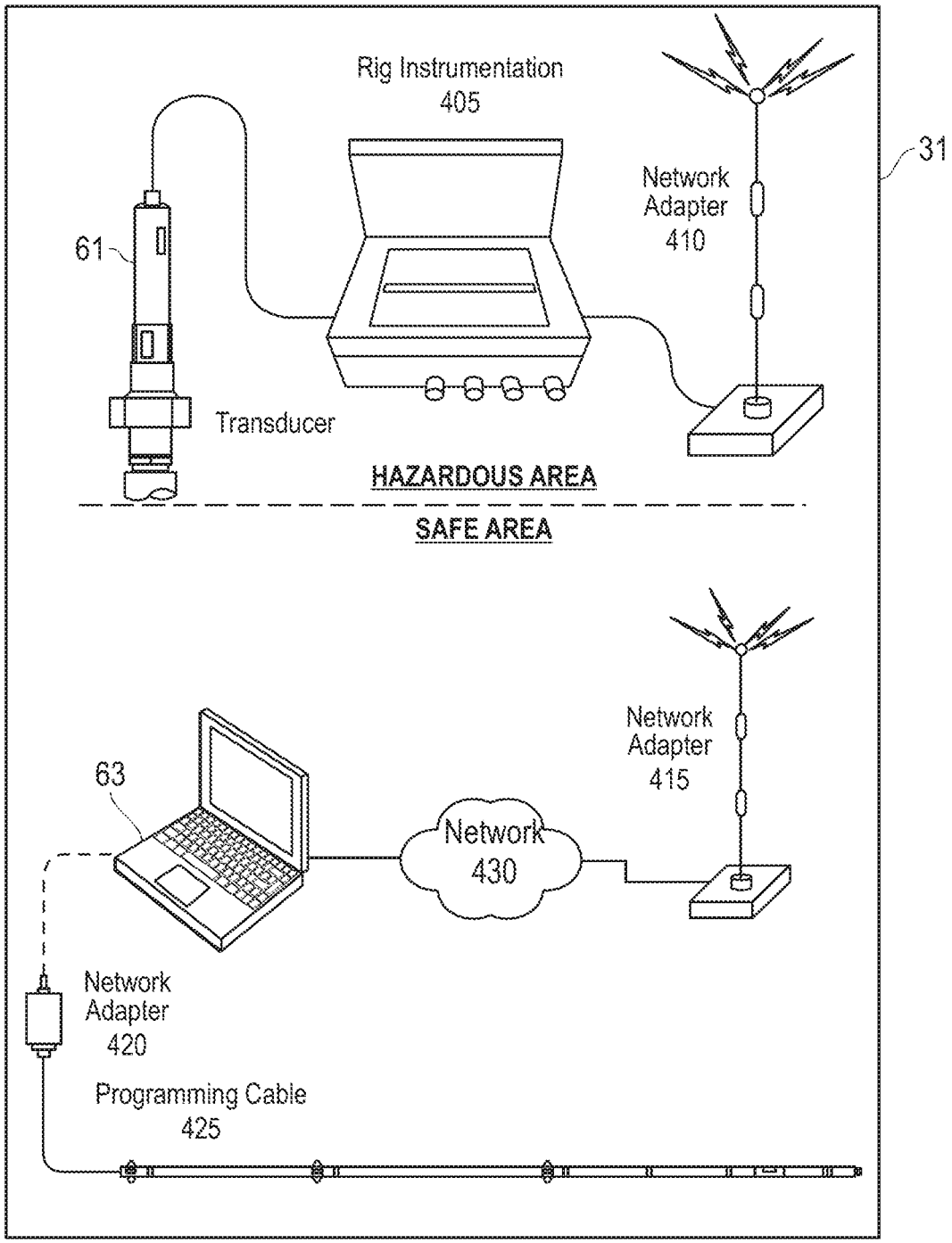
FIG. 4 illustrates external apparatus for receiving and processing uplink pressure pulses from a downhole apparatus, and for generating signals for encoding and downlink transmission according to various embodiments of this disclosure.

FIG. 4 illustrates external apparatus 31 for receiving and processing uplink pressure pulses from a downhole apparatus, and for generating signals for encoding and downlink transmission according to various embodiments of this disclosure.

As shown in the non-limiting example of FIG. 4, external apparatus 31 comprises apparatus in two areas of an above-hole environment—a hazardous area and a safe area. According to certain embodiments, the hazardous area comprises an area including a region (for example, near a wellhead) in which positive pressure mud pulses generated by downhole apparatus can be detected by a transducer. According to certain embodiments, the safe area comprises an area connected to the hazardous area (for example, via a wired or wireless network connection (e.g., Wi-Fi, or Ethernet), where physical proximity to a transducer capable of detecting positive pressure pulses is not required. According to certain embodiments, such as where it is desirable to have a tool programmer close to the drilling site, the safe area and the hazardous area may be mostly or entirely coextensive.

According to certain embodiments, the equipment in the hazardous area comprises a transducer 61, rig instrumentation 405 and network interface 410. Transducer 61 is, in some embodiments, a transducer capable of detecting the pulses generated by the downhole equipment at a well standpipe. Transducers suitable for use according to embodiments of this disclosure include, without limitation, GE™ Pilot transducers and transducers manufactured by General Downhole Technologies, Ltd. To improve performance and resolve pulses associated with higher uplink data transmission rates, transducer 61 may be physically and electromagnetically isolated (for example, by enclosing the transducer in a Faraday cage, and by suspending the transducer mounts) from sources of background noise which can be detected by transducer 61.

In some embodiments, rig instrumentation 405 comprises a rig floor display, which provides operators and systems at the surface of a well with data regarding conditions recorded by a downhole tool and transmitted to the surface, for example using the downhole apparatus described and shown in FIGS. 1-3 of this disclosure. Rig instrumentation 405 receives signals from transducer 61, filters the received signal to remove background noise to produce a signal from which the encoded pulses generated by the downhole system can be recognized, and decodes the pressure spikes associated with encoded pulses to generate downhole data. Apparatus suitable for use as rig instrumentation 405 include, without limitation, a Sondex Rig Floor Display.

According to the non-limiting example of FIG. 4, components of external apparatus 31 disposed within the hazardous area include network adapter 410, which communicatively couples the components (for example, transducer 61 and rig instrumentation 405) to a network (such as an LAN, intranet or the internet). According to certain embodiments, network adapter 410 comprises a wired or wireless router.

As discussed above, external apparatus 31 can, in certain embodiments, include componentry located in a safe area, which as described above, encompasses areas removed from regions of a well (for example, a standpipe) which can be sources of danger to operators. As shown in the non-limiting example of FIG. 4, apparatus in the safe zone can include a second network adapter 415, a network 430, a controller 63, a third network adapter 420 and a programming cable 425.

In some embodiments, second network adapter 415 is an apparatus for receiving MWD data provided by transducer 61 and rig instrumentation 405 and passing same to controller 63. According to certain embodiments, second network adapter is a standalone wired or wireless router or network adapter, which passes data to controller 63 via a network 430 (for example, a wide area network (WAN)). According to other embodiments, second network adapter 415 is an integral component of controller 63, and a separate network 430 may not be required.

According to certain embodiments, controller 63 is an apparatus (for example, a notebook computer) comprising a processor, memory and firmware for modules included in a drilling tool string, as well as modules in external apparatus 31. Modules whose firmware is provided or managed by controller 63 include, without limitation, rig instrumentation 405, transducer 61, modules for controlling the actuation of a pulser (for example, GE Pilot Pulser software, version 6.32), a directional module included in a downhole tool string, modules for controlling surface pumps for transmitting positive pressure mud pulses to downhole equipment.

In some embodiments, external apparatus 31 also include a third network adapter 420, which is in turn, connected to a programming cable 425. According to certain embodiments, third network adapter 420 allows controller to communicate with, and load firmware and other software onto hazardous area and downhole components (for example, transducer 61, pulser actuators, and directional modules) using industry specific data protocols, such as controller area network bus (CANBUS) protocol.

As noted elsewhere in this disclosure, the technical challenges associated with implementing both downlink communications, as well as high amplitude, high data rate uplink communications between external apparatus (for example, external apparatus 31 in FIG. 4), include, without limitation, component failures and leakage in certain downhole components when attempting to generate a rapid stream of high amplitude pulses (for example, leakage around signal shafts, shattering of wear sleeves, and hydraulic locking of piston caps), and the absence of component firmware supporting downlink communication.

According to certain embodiments, downlink communication may be implemented by combining certain abandoned or "obsoleted" software modules, which were released and sold with product literature expressly describing software as being incapable of supporting downlink communication using positive mud pressure pulses. Specifically, according to certain embodiments, downlink communication may be implemented using downhole apparatus (for example, downhole apparatus 21 in FIG. 1) according to embodiments of this disclosure, in conjunction with one or more of the following obsoleted firmware models: GE Pilot MWD v. 6.33 (with GE decoding filters v.1 or v.2, but not v.3 or later); Sondex RFD v.2; General Downhole Technologies, Ltd., transducer firmware 1.00.0316; GE Pilot Pulser actuator firmware v. 6.32 with proprietary mechanics; and GE Directional Module firmware 6.33.

Figure 5:
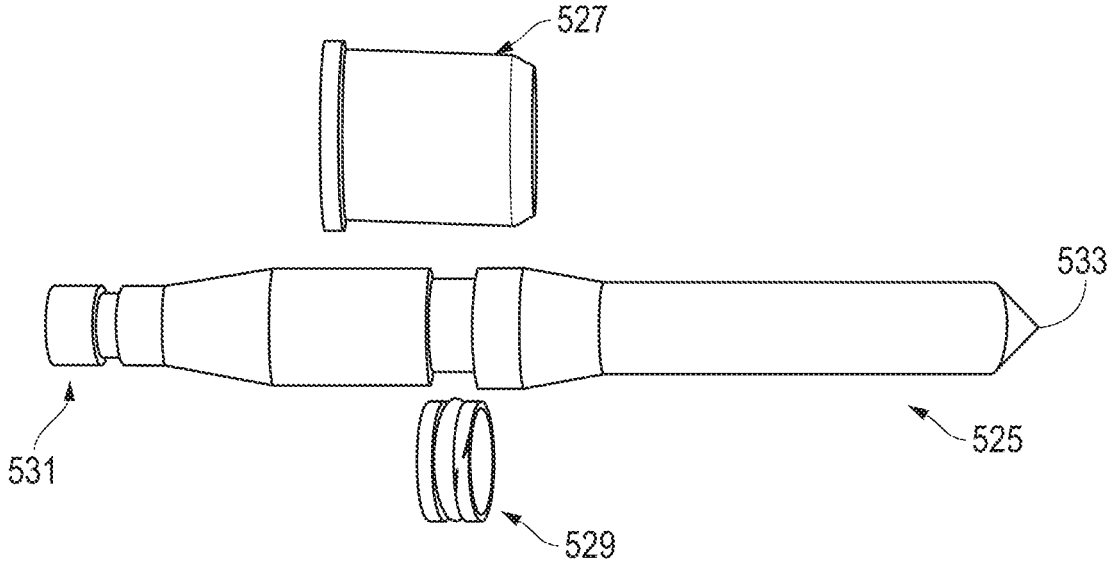
FIG. 5 (Prior Art)
FIG. 5 illustrates a known signal shaft.
Figure 6:
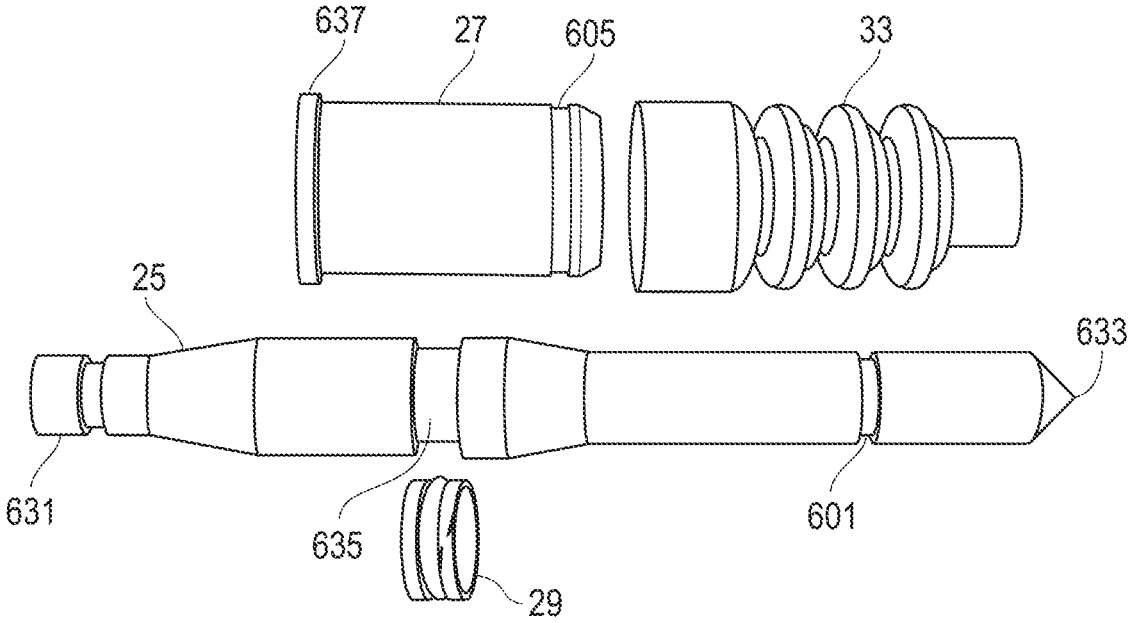
FIG. 6 illustrates an example of a signal shaft according to various embodiments of this disclosure.

FIG. 5 illustrates a known signal shaft and FIG. 6 illustrates a signal shaft according to various embodiments of this disclosure.

As shown in FIG. 5, a known signal shaft 525 comprises a body portion which has a first end 531 configured to engage with a drive shaft which actuates an up and down motion of signal shaft 525, and a second end 533 designed to fit within, and close a poppet orifice. Additionally, as shown in FIG. 5, known signal shaft 525 includes a land 535 designed to hold a t-seal 529. T-seal 529 is configured to slide on an interior surface of ceramic sleeve seal 527. When attempting to generate high amplitude pulses at high data transmission rates, known signal shaft 525 fails, exhibiting leakage around t-seal 529 and excessive wear in ceramic sleeve 527.

Referring to the non-limiting example of FIG. 6, a signal shaft 25 which solves the leakage and wear problems arising when attempting to generate high amplitude positive mud pressure pulses at high data transmission rates. According to various embodiments of this disclosure, signal shaft 25 comprises a body made of a high-strength, non-magnetic material, such as stainless steel. As shown in FIG. 6, signal shaft 25 comprises a first end 631 designed to engage with a drive shaft which actuates an up and down motion of signal shaft 25. Further, signal shaft 25 comprises a second end 633 designed to fit within, and close a poppet orifice (for example, poppet orifice 71 shown in FIG. 1). Additionally, signal shaft 25 comprises a first land 635 for retaining a primary seal 29. According to certain embodiments, primary seal 29 comprises a t-seal configured to slide on an interior surface of ceramic seal 27. Additionally, according to various embodiments, signal shaft 25 comprises a second land 601 configured to retain an end of a secondary seal 33.

As shown in the non-limiting example of FIG. 6, ceramic sleeve 27 has a longer aspect ratio (referring to the length relative to the diameter) than ceramic sleeve 527 shown in FIG. 5. According to certain embodiments, ceramic sleeve 27 has an aspect ratio of 1.5 or greater. Further, according to certain embodiments, ceramic sleeve 27 includes a flange 637 at one end, and a land 605 at another end. Land 605 retains an end of secondary seal 33, which, in some embodiments is a bellows seal.

Figure 7:
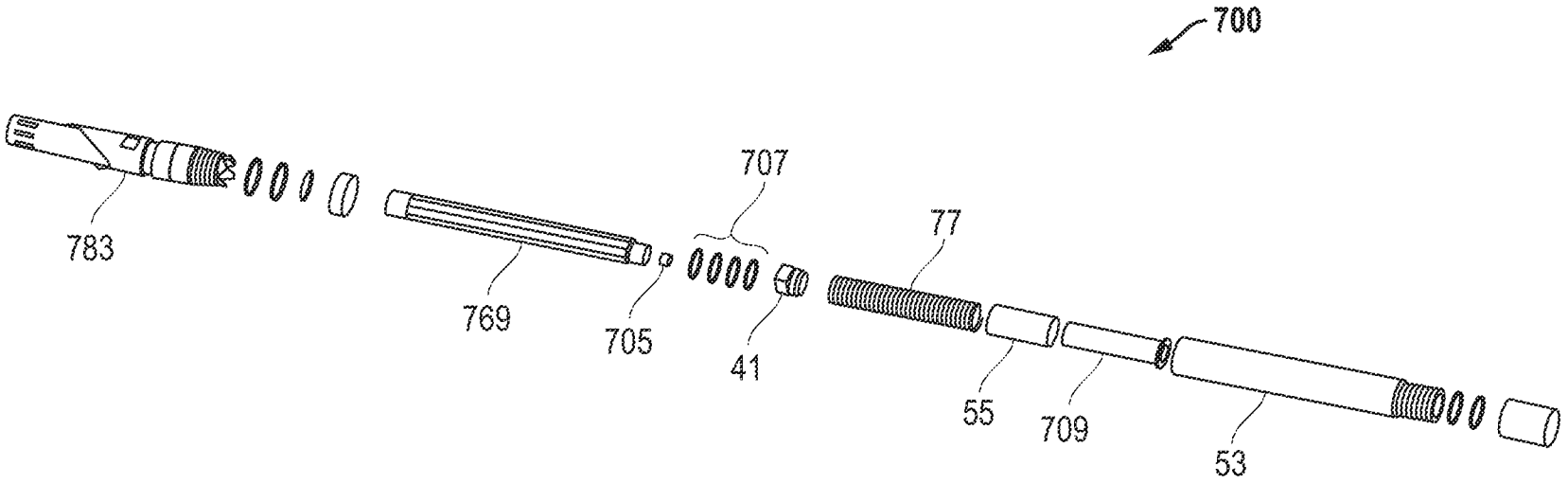
FIG. 7 illustrates an example of a bottom end assembly according to various embodiments of this disclosure.

FIG. 7 illustrates a bottom end assembly 700 according to various embodiments of this disclosure. As shown by the non-limiting example of FIG. 7, bottom end assembly 700 includes pulser helix 783, main shaft 769, main shaft orifice 705, o-ring set 707, piston cap 41, spring 77, wear sleeve 55, ram stop 709, and plenum 53. According to certain embodiments, pulser helix 783 is disposed within a muleshoe sleeve (for example, muleshoe 65 shown in FIG. 1), and supports the main shaft 769. According to certain embodiments, main shaft 769 is a hollow member which is partially supported by pulser helix 783, and which reciprocates relative to plenum 53 in response to hydraulic pressure differentials actuated by the motion of signal shaft 25. According to certain embodiments, main shaft 769 is hollow at a first end and a second end. Further, a hollow cylinder defining a main shaft orifice 705 may be inserted into the first end of main shaft 769, and held in place by piston cap 41. To resolve leaking problems associated with attempting to generate high amplitude positive pressure mud pulses and transmit at high data rates, the connection between piston cap 41 and main shaft 769 is sealed using o-ring stack 707, instead of a single seal. Depending on embodiments, o-ring stack 707 may comprise two, three, four or more o-rings.

As shown in the non-limiting example of FIG. 7, piston cap 41 is attached to the first end of main shaft 769 by threads on the exterior of main shaft 769 and mating threads on the interior of piston cap 41. As will be described in greater detail with respect to FIG. 8, according to certain embodiments, piston cap 41 includes an axial bore and a radial port extending from the axial bore to an exterior of the piston cap.

According to certain embodiments, bottom end assembly 700 further comprises spring 77. In some embodiments, spring 77 has a spring coefficient of 12 lbs/in. In other embodiments, spring 77 has a spring coefficient of 15 lbs/in. In still other embodiments, spring 77 has a spring coefficient greater than 15 lbs/in.

In some embodiments, bottom end assembly 700 comprises wear sleeve 55. To solve material failure and leakage issues arising when attempting to generate high amplitude positive pressure pulses and high data transmission rates, wear sleeve 55 may be constructed from a ceramic material, including, without limitation, silicon nitride ($SiN_4$), alumina oxide ($Al_2O_3$), zirconia oxide ($ZrO_2$) or silicon carbide (SiC). According to other embodiments, wear sleeve 55 is constructed from a nitrogen hardened stainless steel. In some embodiments, bottom end assembly comprises ram stop 709 and plenum 53.

Figure 8:
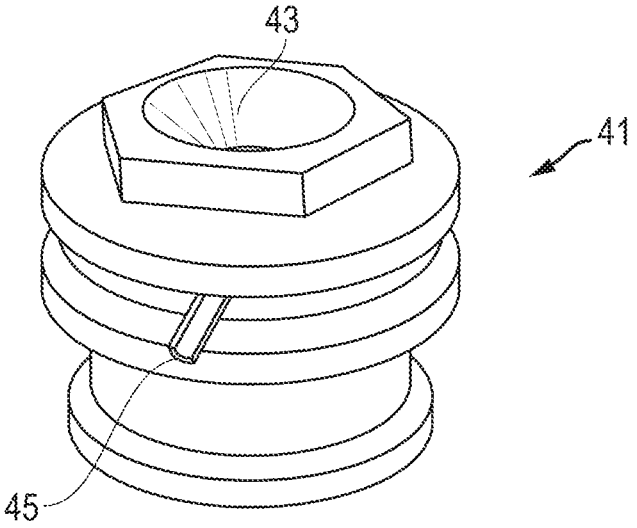
FIG. 8 illustrates an example of a piston cap according to various embodiments of this disclosure.

FIG. 8 illustrates a piston cap 41 according to various embodiments of the present disclosure. According to various embodiments, piston cap 41 is constructed from a high-strength, non-magnetic material, such as nitrogen-strengthened stainless steel. To solve the hydraulic locking problems arising when attempting to generate high amplitude positive mud pressure pulses with known piston caps (for example, piston cap 900 in FIG. 9), piston cap 41 includes an axial bore 43 with a radial port 45 extending to an exterior of the piston cap.

Figure 9:
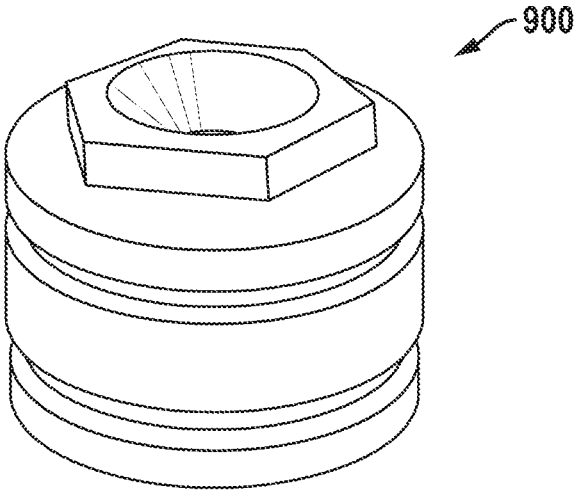
FIG. 9 (Prior Art)
FIG. 9 illustrates a known piston cap.

FIG. 9 illustrates a known piston cap 900, which has been shown to seize up, or cease moving due to hydraulic lock at the main shaft speeds associated with generating high amplitude positive pressure pulses and transmitting data at a high rate. As shown in FIG. 9, known piston cap 900 does not include a radial port 45 to relieve hydraulic pressure which would otherwise create a hydraulic lock.

FIG. 10 illustrates a pressure compensator 1000 according to certain embodiments of this disclosure. According to certain embodiments, pressure compensator 1000 can reside above a pulser (for example, pulser 23) in an MWD tool string and can operate to absorb spikes in mud pressure above a threshold amplitude. According to certain embodiments, housing 1010 is constructed of a high strength non-magnetic material, such as stainless steel. As shown in the non-limiting example of FIG. 10, compression membrane support 1015 fits inside an interior region of compensation membrane 47, which in turn, also fits inside an interior region of housing 1010. As shown in the non-limiting example of FIG. 10, pressure compensator 1000 comprises a housing 1010, a membrane support 1015, a compression membrane 47 and seal pairs 1005*a* and 1005*b*. To solve leakage and structural failure issues arising when attempting to practice positive pressure pulse telemetry with known pressure compensators, compensation membrane 47 is constructed from a thick walled black rubber and seal pairs 1005*a* and 1005*b* comprise stacks of pressure fit rings.

FIG. 11 illustrates an example of a drive shaft assembly 1100 according to some embodiments of this disclosure. According to certain embodiments, drive shaft assembly 1100 connects to a signal shaft (for example, signal shaft 25 in FIG. 1) at a connection tip 1105, which may be constructed of a hardened material, such as a carbide steel. As shown in the non-limiting example of FIG. 11, connection tip 1105 is connected through a stack of spacers and compression springs 1125 to a drive shaft 79. To relieve hydraulic pressure buildup, drive shaft 79 includes a groove 1110 with a larger than normal width (e.g., about 0.09 in to about 0.15 in, such as about 0.12 in). According to certain embodiments, the up and down motion of a signal shaft (for example, signal shaft 25 in FIG. 1) is controlled through motor drive shaft 79, in response to a motor-controlled actuator 81. According to certain embodiments, actuator 81 comprises a corkscrew shaft connected at a first end to a ball screw hub 1115 having a first bearing 49, and connected at a second end through a second bearing 51 to a thrust bearing mount 1153. According to certain embodiments, actuator 81 is contained within housing 1120. According to various embodiments, at least one of first bearing 49 or second bearing 51 is a hybrid bearing with steel races and ceramic balls.

Figure 12:
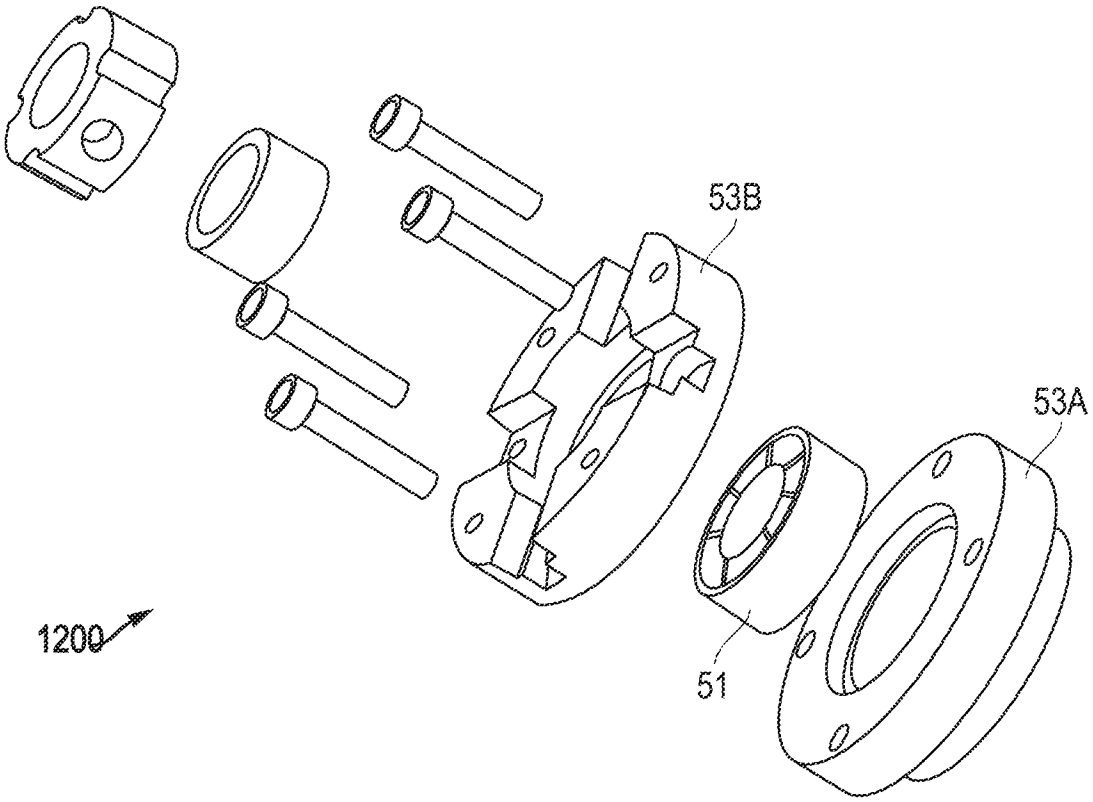
FIG. 12 illustrates an example of a thrust bearing mount assembly according to certain embodiments of this disclosure.

FIG. 12 illustrates a thrust bearing mount assembly 1200 according to various embodiments of this disclosure. According to various embodiments, thrust bearing mount 1200 comprises a pair of body halves 53A and 53B which retain thrust mount bearing 51, which is in contact with a portion of an end of an actuator (for example, actuator 81 in FIG. 11). Further, thrust bearing mount 1200 includes a bearing support sleeve 1210, into which part of an end of an actuator (for example, actuator 81 in FIG. 11) sits. Further, thrust bearing mount 1200 includes a shaft nut 1205 for maintaining engagement between the actuator and bearing 51.

None of the description in this application should be read as implying that any particular element, step, or function is an essential element that must be included in the claim scope. The scope of patented subject matter is defined only by the claims. Moreover, none of the claims is intended to invoke 35 U.S.C. § 112(f) unless the exact words "means for" are followed by a participle.

What is claimed is:

1. A method of operating a downhole pulser coupled to a drill string, the method comprising:

passing drilling fluid through a main orifice and into a main fluid passage of the downhole pulser, the passing with a sealing surface of a main shaft displaced away from the main orifice, and the passing with a poppet orifice of the downhole pulser closed; and then creating a positive pressure pulse in the drill string between the downhole pulser and surface equipment by:

opening the poppet orifice and thereby equalizing pressure as between a plenum and the main fluid passage;

forcing the main shaft to seal against the main orifice by a main spring, thereby creating the positive pressure pulse;

ceasing the positive pressure pulse by:

closing the poppet orifice, the poppet orifice fluidly coupled to the plenum;

bleeding drilling fluid from the plenum through a port to the main fluid passage, the bleeding creates a differential pressure between the plenum and the main fluid passage; and compressing the main spring by the differential pressure, the compressing displaces the main shaft from the main orifice, and the displacement caused by the compressing creates fluid flow through the main fluid passage;

repeating the creating the positive pressure pulse and ceasing the positive pressure pulse at a rate of eight pulses per second or more as predetermined by software configuration settings; and encoding data in the positive pressure pulses.

2. The method of claim 1, wherein the data encoded is responsive to downlink telemetry from the surface equipment.

3. The method of claim 1 wherein bleeding drilling fluid further comprises bleeding the drilling fluid from the plenum through the port defined in a piston cap, the piston cap coupled to the main shaft and defining a flow pathway from the inside of the main shaft to the plenum.

4. The method of claim 1 wherein forcing the main shaft to seal further comprises forcing the main shaft to seal against the main orifice by the main spring disposed within the plenum.

5. The method of claim 1 wherein bleeding the drilling fluid from the plenum further comprises bleeding the plenum and an inside diameter of the main shaft, the bleeding to the main fluid passage.

6. The method of claim 1 wherein compressing the main spring by the differential pressure further comprises translating a piston cap coupled to the main shaft toward the poppet orifice within a wear ring that remains stationary relative to the poppet orifice.

7. The method of claim 6 wherein translating the piston cap within the wear ring further comprises translating within the wear ring constructed of silicon nitride.

8. The method of claim 6 wherein translating the piston cap within the wear ring further comprises translating within the wear ring constructed of a nitrogen-strengthened stainless steel.

9. The method of claim 1 wherein opening the poppet orifice further comprises translating a signal shah telescoped through a shaft seal and a bellows seal, the signal shaft coupled to the bellows seal, and the shaft seal remains stationary as the signal shaft translates away from the poppet orifice.

10. The method of claim 1 wherein closing the poppet orifice further comprises translating a signal shaft telescoped through a shaft seal and a bellows seal, the signal shaft coupled to the bellows seal, and the shaft seal remains stationary as the signal shaft translates toward the poppet orifice.

11. A method of operating a downhole pulser coupled to a drill string, the method comprising:

passing drilling fluid through a main orifice and into a main fluid passage of the downhole pulser, the passing with a sealing surface of a main shaft displaced away from a main orifice, and the passing with a poppet orifice of the downhole pulser closed; and then equalizing pressure as between a plenum and the main fluid passage, the equalizing by opening the poppet orifice;

closing the main shaft against the sealing surface by force of a main spring, thereby creating a positive pressure pulse; and then creating differential pressure as between the plenum and the main fluid passage by closing the poppet orifice, and bleeding drilling fluid from the plenum to the main fluid passage;

opening the main orifice, the opening by compressing the main spring with force provided by the differential pressure, the opening of the main orifice ceases the positive pressure pulse; and repeating the creation of the positive pressure pulse and cessation of the positive pressure pulse at a rate of eight pulses per second or more.

12. The method of claim 11 herein equalizing the pressure further comprises translating a signal shaft telescoped through a shaft seal and a bellows seal, the signal shaft coupled to the bellows seal, and the shaft seal remains stationary as the signal shaft translates away from the poppet orifice.

13. The method of claim 11 wherein creating differential pressure further comprises translating a signal shaft telescoped through a shaft seal and a bellows seal, the signal shaft coupled to the bellows seal, and the shaft seal remains stationary as the signal shaft translates toward the poppet orifice.

14. The method of claim 11, wherein opening the main orifice further comprises translating a piston cap coupled to the main shaft toward the poppet orifice within a wear ring that remains stationary relative to the poppet orifice.

15. The method of claim 14 wherein translating the piston cap within the wear ring further comprises translating within the wear ring constructed of silicon nitride.

16. The method of claim 14, wherein translating the piston cap within the wear ring further comprises translating within the wear ring constructed of a nitrogen-strengthened stainless steel.

17. The method of claim 11 wherein creating differential pressure as between the plenum and the main fluid passage further comprises bleeding the drilling fluid from the plenum through a port defined in a piston cap, the piston cap coupled to the main shaft and defining a flow pathway from inside of the main shaft to the plenum.

18. The method of claim 11 wherein closing the main shaft against the sealing surface further comprises forcing the main shaft to seal against the main orifice by the main spring disposed within the plenum.

19. The method of claim 11 further comprising encoding data in the positive pressure pulses, such that data transmitting options are responsive to downlink telemetry from surface equipment.

* * * * *